US007238275B2

(12) United States Patent
Stupin et al.

(10) Patent No.: US 7,238,275 B2
(45) **Date of Patent: *Jul. 3, 2007**

(54) COMBINED HYDROTREATING PROCESS AND CONFIGURATIONS FOR SAME

(75) Inventors: Steven Stupin, Orange, CA (US); Garry Jacobs, Aliso Viejo, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 479 days.

This patent is subject to a terminal disclaimer.

(21) Appl. No.: 10/478,704

(22) PCT Filed: Apr. 5, 2002

(86) PCT No.: PCT/US02/10559

§ 371 (c)(1),
(2), (4) Date: May 5, 2004

(87) PCT Pub. No.: WO03/086567

PCT Pub. Date: Oct. 23, 2003

(65) Prior Publication Data

US 2004/0173503 A1 Sep. 9, 2004

(51) Int. Cl.
*C10G 65/00* (2006.01)
*B01J 8/04* (2006.01)

(52) U.S. Cl. ..... 208/58; 208/59; 208/80; 208/89; 208/97

(58) Field of Classification Search ..... 422/190; 208/58, 59, 89, 97, 80
See application file for complete search history.

(56) References Cited

U.S. PATENT DOCUMENTS

| | | | | |
|---|---|---|---|---|
| 4,344,840 | A * | 8/1982 | Kunesh | 208/59 |
| 5,026,950 | A * | 6/1991 | Schmidt et al. | 585/737 |
| 5,904,835 | A * | 5/1999 | Thakkar | 208/78 |
| 6,217,746 | B1 * | 4/2001 | Thakkar et al. | 208/59 |
| 6,547,956 | B1 * | 4/2003 | Mukherjee et al. | 208/58 |
| 6,676,828 | B1 * | 1/2004 | Galiasso et al. | 208/58 |
| 6,797,154 | B2 * | 9/2004 | Mukherjee et al. | 208/58 |
| 2003/0111385 | A1 * | 6/2003 | Cash et al. | 208/58 |
| 2004/0173503 | A1 * | 9/2004 | Stupin et al. | 208/108 |

OTHER PUBLICATIONS

UOP, Process Technology and Equipment/Advanced Partial Conversion Unicracking Process, 2003.

* cited by examiner

*Primary Examiner*—N. Bhat
(74) *Attorney, Agent, or Firm*—Fish & associates, PC

(57) ABSTRACT

At least two feedstocks (210A) (210B) with different boiling point ranges are hydrotreated in an integrated hydrogenation plant (200) using an interbed separator (240) that is fluidly coupled between two hydrogenation reactors (230A) (230B). Contemplated configurations and methods will significantly reduce construction and operating cost by integration of at least two hydrogenation processes of two different feedstocks into one process, and/or by providing process conditions that reduce use of catalyst in at least one of the reactors.

24 Claims, 3 Drawing Sheets

- Prior Art -

COMBINED HYDROTREATING PROCESS AND CONFIGURATIONS FOR SAME

FIELD OF THE INVENTION

The field of the invention is petrochemistry, and particularly hydrotreating of various hydrocarbonaceous feedstocks.

BACKGROUND OF THE INVENTION

Hydrotreating is a type of hydroprocessing commonly used in many modern refineries, in which hydrogen is contacted in the presence of a catalyst with a hydrocarbonaceous feedstock to remove impurities, including oxygen, nitrogen, sulfur, and to saturate hydrocarbons. A frequently employed form of hydrotreating is hydrodesulfurization, which is used primarily to reduce the sulfur content from refinery intermediate streams. Hydrodesulfurization is typically used in combination with processes including feed pretreatment of catalytic reformers, fluidized-bed catalytic crackers, and hydrocrackers, and may also be used independently as a product quality improvement step for naphtha, diesel, jet, heating oil and residues, saturation of olefins, and polycyclic aromatics. Hydrocracking is another type of hydroprocessing commonly used in many modern refineries, in which hydrogen is contacted in the presence of a catalyst with a hydrocarbonaceous feedstock to produce lighter products (i.e., the average molecular weight decreases). There are numerous hydroprocessing configurations and processes known in the art, and continuous efforts to reduce energy consumption and capital cost, while improving product quality, has led to integration of hydrotreating and hydrocracking reactors in various processes.

For example, in one integration concept, a hydrotreater is combined with a hydrocracker as disclosed in U.S. Pat. No. 3,328,290 to Hengstebeck that describes a two-stage hydrocracking process wherein fresh feedstock is combined with effluent from the hydrocracking stage and the combined streams are then introduced into a hydrotreating stage. A higher-boiling fraction is then separated from the hydrotreater effluent and fractionated to produce a light product and a heavier bottoms stream, which is then recycled with hydrogen-containing gas back to the hydrocracking stage.

Another example U.S. Pat. No. 6,235,190 to Bertram describes an integrated hydrotreating and hydrocracking process in which two hydrotreating catalysts of different activities are operated in series to provide improved product quality, wherein the effluent from a hydrotreating reactor is subjected to a hydrocracking process to convert the hydrotreated effluent to lighter products with a reduced aromatic hydrocarbon content. In a further example, U.S. Pat. No. 6,261,441 to Gentry et al., a combined hydrotreating/hydrocracking process is described in which a hydrocracking stage is followed by a hydrodewaxing stage with a single feedstock and a bottoms fraction recycle to produce a naphtha product, a distillate boiling above the naphtha range, and a lubricant product.

In yet another system, as described in U.S. Pat. No. 6,328,879 to Kalnes, two independent feedstocks are hydrocracked in a catalytic hydrocracking process that employs a hydrocracking zone, a hydrotreating zone, and a high pressure product stripper to produce various products, wherein the products have a lower boiling point range than the feedstocks.

Alternatively, more than one hydrotreater reactor, and or catalyst beds may be employed for catalytic hydrogenation as described in U.S. Pat. No. 3,537,981 to Parker, or U.S. Pat. No. 6,103,105 to Cooper. While Parker's process employs a first hydrotreating reactor coupled to a separator that is in series with a second hydrotreating reactor, Cooper et al. employ two serially connected hydrotreating catalyst beds without the use of a separator. However, both Coopers and Parkers hydrotreating configurations are typically limited to only a single feedstock.

Thus, although many integrated processes have provided at least some advantage over other known configurations and methods, all or almost all of the known configurations and methods are limited to processes in which hydrocracking is the objective, or in which hydrotreating of a single boiling range (e.g., naphtha, diesel, gasoil, resid) feedstock is considered. Consequently, all or almost all of the known hydrotreating processes require separate plants where more than one feedstock is employed. Therefore, there is still a need to provide improved configurations and methods for hydrotreating of petroleum products.

SUMMARY OF THE INVENTION

The present invention is directed to configurations and methods for hydroprocessing plants, and especially for integrated hydrotreating plants in which at least two feedstocks with different boiling point ranges (e.g., gas oil and diesel oil) are hydrotreated. Further especially contemplated aspects include methods for controlling contemplated configurations.

In one aspect of the inventive subject matter, contemplated plants include an interbed separator that receives a first feed (e.g., hydrotreated gas oil) and a second feed (e.g., diesel oil), wherein the first feed preheats and vaporizes at least part of the second feed, thereby producing a preheated and at least partially vaporized second feed, and wherein at least a portion of the first feed is provided by a first hydrotreating reactor, and wherein at least a portion of the preheated and at least partially vaporized second feed is fed into a second hydrotreating reactor that produces a product.

Especially contemplated interbed separators include at least a partial vapor liquid equilibrium stage, preferably at least two vapor liquid equilibrium stages, and may have a configuration of a trayed column or a packed column. It is further preferred that contemplated interbed separators may receive a hydrogen rich stream, which may be recycled in the plant, and/or which may be a makeup hydrogen stream. Contemplated interbed separators are typically operated at a pressure similar to the operating reactor pressure of about 500 psi to about 2400 psi.

In particularly preferred aspects of the inventive subject matter, at least a portion of the second feed is fed into the second hydrotreating reactor, at a rate effective to control light-end recovery of the hydrotreated first feed in the interbed separator. The remaining portion of the second feed may then be employed to regulate a temperature in the second hydrotreating reactor.

In another aspect of the inventive subject matter, first and second hydrotreating reactors are operated at conditions under which the hydrotreating reactor feed will exhibit less than 10% conversion, and more preferably less than 8% conversion. Thus, contemplated second hydrotreating reactors are preferably operated at a pressure of between about 700 psi and about 2400 psi.

Furthermore, it is contemplated that configurations according to the inventive subject matter may be realized in a new plant. However, the interbed separator and the second hydrotreating reactor may also be integrated as an upgrade into an existing hydroprocessing plant.

In a further aspect of the inventive subject matter, a method of hydrotreating includes one step in which a first hydrotreating reactor, a second hydrotreating reactor, and an interbed separator that receives a first feed and a second feed are provided. In another step, the interbed separator is fluidly coupled to the first and second hydrotreating reactors. In a still further step, the hydrotreated first feed is used to preheat and vaporize at least part of the second feed, thereby producing a preheated and at least partially vaporized second feed, and in another step, at least a portion of the preheated and at least partially vaporized second feed is mixed with another part of the second feed and fed into the second hydrotreating reactor.

DETAILED DESCRIPTION

Figure 1:
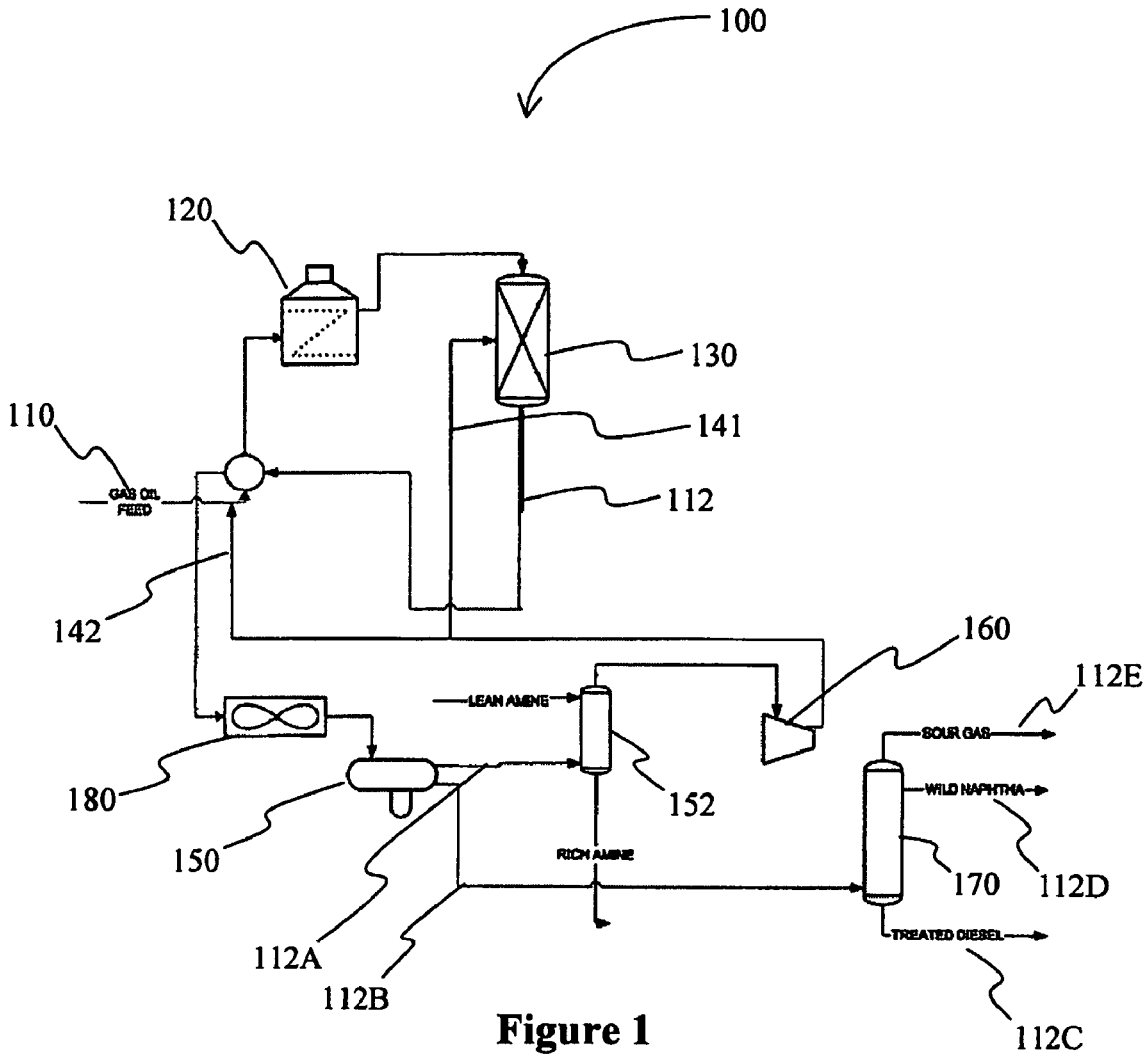
FIG. 1 is a schematic view of an exemplary configuration of a prior art hydrotreating plant.

Various known configurations and processes for desulfuration and/or denitrification utilize a process that employs a hydrotreating reactor in which a hydrocarbonaceous feed is reacted with hydrogen in the presence of a catalyst to form $H_2S$ and/or $NH_3$ from sulfur-and/or nitrogen-containing compounds in the feedstock. Prior Art FIG. 1 depicts a typical configuration 100 for such plants. Here, a single feedstock (e.g., diesel) 110 is passed through a heater 120 and subsequently fed into a hydrotreating reactor 130. Hydrogen (separately [via line 141], or in combination [via line 142] with the feedstock) is added to the catalyst in the hydrotreating reactor and the hydrotreated product 112 is (after a cooling step in cooler 180) separated in separator 150 into a gaseous portion 112A, which predominantly comprises hydrogen, hydrogen sulfide, and light non-condensable hydrocarbons and a liquid portion 112B, which comprises hydrotreated diesel, some wild naphtha, and remaining sour gas. The hydrogen from the gaseous portion is typically purified in an absorber 152 with an amine-containing solvent, and recycled (supra) into the hydrogen reactor via compressor 160. The hydrotreated product 112C can then be retrieved from column 170 along with typical products such as wild naphtha 112D and sour gas 112E. While such configurations work relatively well for a single type of feedstock (e.g., vacuum gas oil, gas oil, diesel, naphtha, etc.), known plants with multiple feedstocks (e.g., gas oil and diesel) generally require multiple and separate hydrotreating configurations, which add significant cost to construction and operation of such plants.

In their efforts to improve configurations and methods for hydrotreating hydrocarbonaceous feeds, the inventors have discovered that multiple feedstocks (ie., feedstocks with different boiling point ranges—e.g., gas oil and diesel) can be hydrotreated in an integrated configuration, in which an interbed separator is fluidly coupled to a first and a second hydrotreating reactor, and in which a single hydrogen recycling loop (e.g., comprising a cooler or heat exchanger, a liquid/gas separator, an amine stripper, and a compressor) can be employed for two (or more) hydrotreating reactors each treating different feeds.

Consequently, in a particularly preferred aspect of the inventive subject matter, a plant may comprise an interbed separator that-receives a first feed and a second feed, wherein the first feed preheats and vaporizes at least part of the second feed, thereby producing a preheated and at least partially vaporized second feed, wherein at least a portion of the first feed is provided by a first hydrotreating reactor, and wherein at least a portion of the preheated and at least partially vaporized second feed is fed into a second hydrotreating reactor that produces a product.

Figure 2:
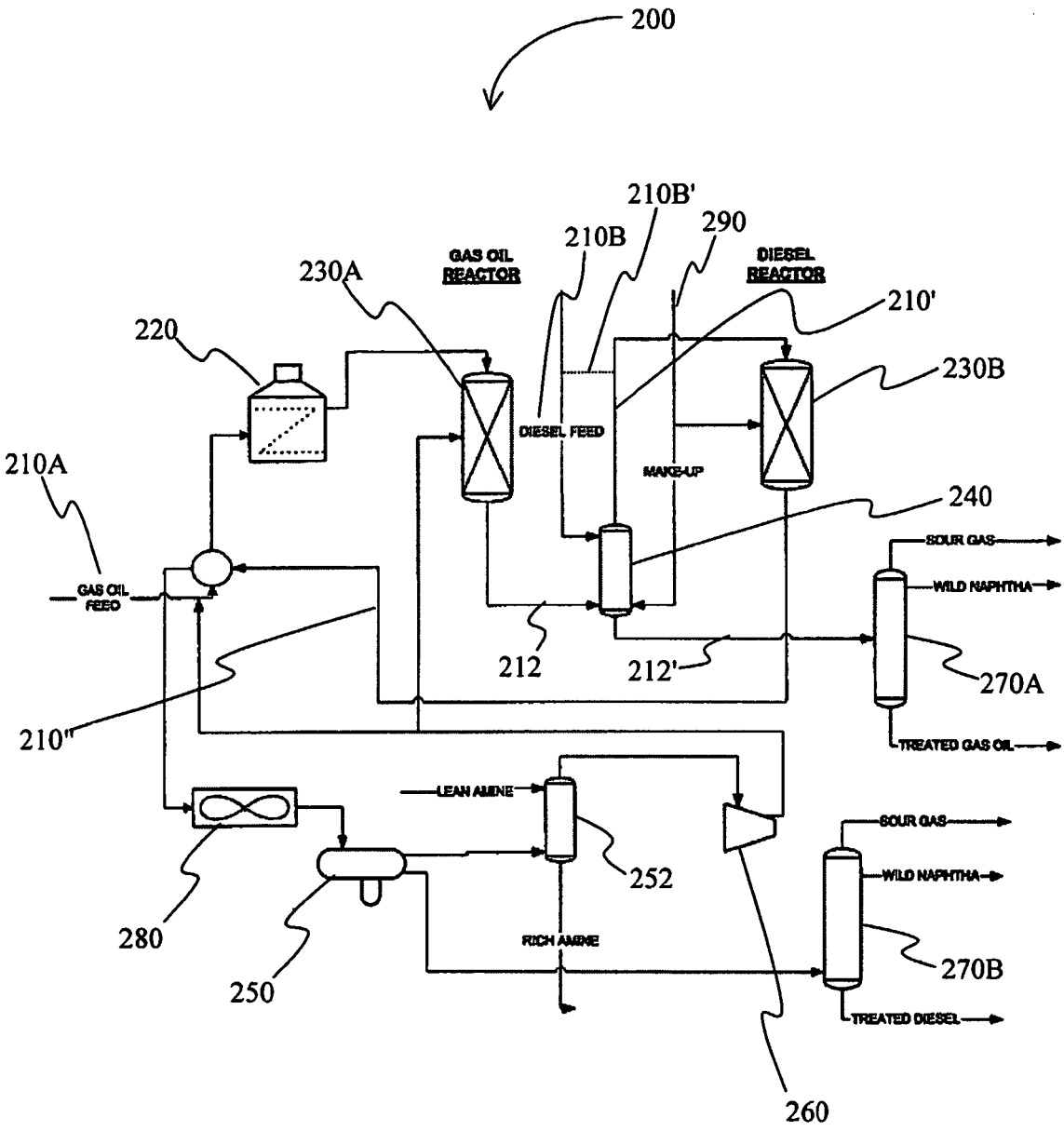
FIG. 2 is a schematic view of an exemplary configuration of a hydrotreating plant according to the inventive subject matter.

FIG. 2 depicts an exemplary configuration of a hydroprocessing plant 200, in which two different hydrocarbonaceous feedstocks are hydrotreated using an integrated configuration with a single hydrogen recycle loop. Here, gas oil 210A (first hydrocarbonaceous feedstock) is heated in heater 220 and then introduced into the hydrotreating reactor 230A to produce a hydrotreated product 212 (which is the first feed for the interbed separator). The hydrotreated product 212 is then fed into the interbed separator (hot separator) 240. It should be recognized that the hydrotreated product 212 may pass through equipment (e.g., heat exchangers, etc.) prior to entering the interbed separator 240. The interbed separator 240 also receives diesel feed 210B (the second feed for the interbed separator, which may be preheated) and which is preferably at least partially (i.e., at least 10-50%, more typically 50 to 80%, most typically, 80 to 100%) in the liquid phase. A vapor feed 290, typically hydrogen (or hydrogen-containing) may further be fed into the interbed separator, wherein the vapor feed may be partially recycled within the plant. Alternately, the vapor feed (or hydrogen containing feed) may be at least in part make-up hydrogen.

Within the separator the second feed is at least partially vaporized (or further vaporized) and heated by direct contact with the hydrotreated product 212. Additionally, the interbed separator 240 separates the feeds into products in which the more volatile components will exit the separator with the vaporized second feed 201', and the less volatile components will exit with the somewhat cooled hydrotreated separator product 212'. The interbed separator will include at least a partial vapor liquid equilibrium stage, or more preferably two or more vapor liquid equilibrium stages, and may have a configuration of a trayed column or a packed column. The liquid hydrotreated product 212' is then fed into column 270A that separates the liquid hydrotreated product 212' into treated products including but not limited to gas oil, wild naphtha, and sour gas. The vaporized second feed 210' is then mixed with additional diesel feed via line 210B' and introduced (as combined second feed) into the second hydrotreating reactor 230B, which may or may not receive additional feed streams. It should be appreciated that a portion of the lighter boiling range components will be recovered from the first product 212' and further hydrotreated in the second reactor.

The so hydrotreated second feed 210" (here: mostly hydrotreated diesel) is then cooled in cooler 280 and separated in separator 250 into a liquid portion and a gaseous portion (predominantly comprising $H_2S$, hydrogen, and light non-condensable hydrocarbons). The hydrogen in the gaseous portion can be purified via absorber 252, which may use conventional solvents. The compressor 260 compresses this hydrogen-containing recycle gas stream to a suitable pressure for re-introduction into the system (e.g., at first reactor and/or into first feed or feedstock). The liquid portion of the second hydrotreated feed 210" is then fed into column

270B that separates the hydrotreated products into treated products which can include, but are not limited to, low sulfur diesel, wild naphtha, and sour gas.

As also used herein, the term "interbed separator" refers to a separator that is fluidly coupled to at least two hydroprocessing reactors such that the interbed separator receives an at least partially hydrotreated first feed and a second feed (which may or may not have been previously hydrotreated), wherein first and second feeds have different boiling point ranges (e.g., gas oil and diesel oil). Typically, contemplated interbed separators are operated hot (i.e., 300 to 750° F.), and it is especially contemplated that the interbed separator further may receive a vapor or a hydrogen-containing feed.

Figure 3:
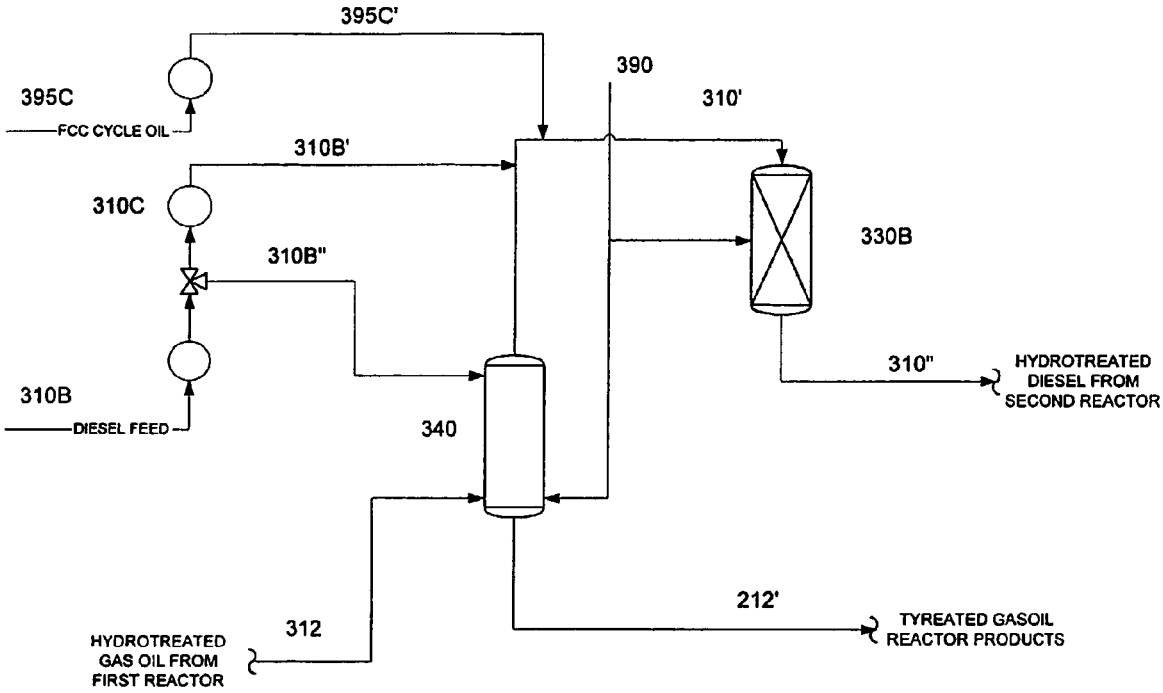
FIG. 3 is a schematic detail view of streams relating to the interbed separator according to the inventive subject matter.

FIG. 3 depicts an especially preferred configuration of the streams around the interbed separator 340 and the second reactor in which a portion 310B' of the second feed 310B, and an additional third feed 395C is fed to the second reactor (via combined stream 310'), bypassing the interbed separator, to produce a hydrotreated product 310". The rate of the substantially liquid phase stream 310B" (of the second feed) is determined to allow for the desired light end recovery from the first hydrotreated feed stock 312'. The term "light-end recovery" as used herein refers to the recovery of components in a component-mixture, wherein the boiling point of the components is in the upper third, and more typically upper fourth (or even higher) of the boiling point range of the mixture. The remaining portion of the second feed stock 310B' may be additionally preheated in a heat exchanger or heater 310C, before being directed to the second reactor. It should be recognized that the third feed may be any hydrocarbonaceous feedstock, and may include naphtha, jet, diesel, or gas oil boiling range material. It should also be recognized that additional (forth, fifth, etc.) feed streams can be fed to the second reactor, bypassing the interbed separator. In this exemplary configuration the third feed stock 395C is Cycle Oil from an FCC unit. In this preferred configuration the second reactor operates at a steady feed rate while allowing for good operating flexibility in the operation of the interbed separator, and good light end recovery control. It should also be recognized that the reactor 330B may operate in a two-phase (vapor/liquid) or preferably trickle flow regime.

To maintain a particular inlet temperature to the second reactor 330B, the feed temperatures of heated streams 310B' and/or 395C' can be adjusted via integrated (using internal streams within the plant or stripping or fractionation sections) or external heat sources. This ability to adjust the feed temperature of the portion of the feed that bypasses the interbed separator is especially advantageous, since directing a portion of the feed to the second hydrotreating reactor will resolve difficulties associated with the heat balance (e.g., the hydrogen stream 390 would have to be temperature controlled (e.g., as hot hydrogen stripping gas) to circumvent heat imbalance). The amount of the second feed that bypasses the interbed separator (e.g., by direct feeding into the hydrotreater downstream of the interbed separator) will also depend on the relative volumetric rates of the first and second reactor feed stocks. As the volumetric rate of the second reactor feed increases, relative to the first reactor feed, the percentage of the second reactor feed bypassing the interbed separator will typically increase.

Still further, it should be recognized that the portion of the second feed (or an alternate third feed) that bypasses the interbed separator (e.g., via direct feed into the second hydrotreater) may be preheated or temperature controlled. Consequently, it should be recognized that temperature control of the portion of the second feed may be employed to control the inlet temperature of the second hydrotreating reactor over a relatively wide range (e.g., +–75 degrees F.). Therefore, the portion of the second feed that bypasses the interbed separator may typically be in a range of between about 20 vol % (or less) to about 80 vol % (or more) of the entire volumetric rate of the second feed. Most typically, however, the amount of the portion of the second feed that bypasses the interbed separator will be about 35-65 vol %. Preferably, the additional feeds (third, forth, etc.) will be at least partially liquid phase (below its dew point, prior to the addition of makeup or recycle gas, if any, at the conditions (temperature and pressure) when first fed into the recycle loop, or when measured at the reactor inlet temperature, and pressure). Thus, it should be recognized that in some of the contemplated configurations, and especially in those in which a portion of the second or third feed are in liquid phase and fed into the second hydrotreating reactor, the second hydrotreating reactor is operated in a two-phase, or preferably trickle flow regime.

It should further be especially recognized that in preferred aspects of the inventive subject matter both hydrotreating reactors are operated under conditions effective to reduce the concentration of sulfur- and/or nitrogen-containing compounds in the feeds. Consequently, it should be recognized that in preferred configurations both feedstocks are substantially not (L e., less than 10%, more typically less than 8%) converted to lower boiling point products. In particularly preferred aspects, the second feedstock comprises diesel, and the diesel contains after hydrotreating and column separation less than 50 ppm, more preferably less than 25 ppm, and most preferably less than 10 ppm sulfur-containing products.

Thus, contemplated configurations may be employed for production of two products having different boiling ranges and different product specifications. For example, an existing gas oil hydrotreating plant upstream of a FCC unit may be upgraded, with relatively low capital investment, to include a second reactor (or reactor section) for producing high quality low sulfur diesel fuel. It should be especially recognized that in such configurations the required capacity increase for the existing heater, heat exchanger train and coolers will be moderate to insignificant since additional heat can leave the system via the product from the interbed separator to be used as stripper preheat.

Still further, it should be recognized that the concept of bypassing a portion of the second feedstock around the interbed separator (e.g., by feeding into the hydrotreater downstream of the interbed separator) may also be employed in alternative integrated configurations and methods, and especially contemplated alternative configurations include those in which a first hydrocracking reactor is serially coupled to a second hydrotreating reactor (see e.g., U.S. Pat. No. 6,328,879 to Kalnes, incorporated by reference herein).

Still further, it should be recognized that the concept of bypassing a portion of the second feedstock around the interbed separator may also be extended to alternative integrated configurations and methods, and especially contemplated alternative configurations include those in which a first hydrotreating reactor is serially coupled to a second hydrocracking reactor.

Among other advantages, adding a fluid portion of the third feed to the second reactor, without passing through an interbed separator, will allow processing of a higher boiling point range material (i.e. similar to the first feedstock) without loss of the higher boiling range fraction of the third feedstock in a separator. Moreover, potential difficulties associated with the heat balance may be reduced, if not entirely avoided.

It should be especially appreciated that the terms "hydrocracking" and "hydrotreating" are not referring to the same type of hydroprocess occurring in the reactor. As used herein, the term "hydrocracking reactor" as used herein refers to a reactor in which a hydrocarbon-containing feed is converted to lighter products (i.e., the average molecular weight decreases), wherein the term "conversion" or "converted" means that a particular percentage of fresh feed changes to middle distillate, gasoline and lighter products (see e.g., "Hydrocracking Science And Technology" by J. Scherzer and A. J. Gruia; Marcel Decker, Inc.). Thus, contemplated hydrocracking reactors will have a conversion of at least 15%, more typically at least 30%, and most typically at least 50%. In contrast, the term "hydrotreating reactor" refers to a reactor in which a hydrocarbon-containing feed is reacted with hydrogen in the presence of a catalyst under conditions that (a) result in less than 15% conversion, and more typically less than 10% conversion, and (b) result in the formation of $H_2S$ and/or $NH_3$ from sulfur- and nitrogen-containing compounds in the hydrocarbon-containing feed.

With respect to the first, second, and third hydrocarbonaceous feedstocks (210A, 210B, and 395C) it should be appreciated that various hydrocarbonaceous feedstocks are considered suitable for use herein, and in especially contemplated aspects the first hydrocarbonaceous feedstock comprises gas oil or any petroleum fraction with a boiling point range higher than diesel and the second hydrocarbonaceous feedstock comprises diesel, or any fraction with a boiling point range lower than the first feedstock. In a still further especially contemplated aspect, the third hydrocarbonaceous feedstock may comprise any feedstock regardless of boiling range. Suitable hydrocarbonaceous feedstocks include crude or partially purified petroleum fractions, including light gas oil, heavy gas oil, straight run gas oil, deasphalted oil, kerosene, jet fuel, cycle oil from an upstream FCC (fluid catalytic cracking) reactor etc. While not limiting to the inventive subject matter, it is generally preferred that suitable first and second hydrocarbonaceous feedstocks have different boiling point ranges, wherein the first hydrocarbonaceous feedstock typically has a boiling point range that is higher (at least 5 degrees centigrade, more typically at least 10 degrees centigrade, and most typically at least 25 degrees centigrade as measured from the mid volume boiling point in the boiling point range) than the second boiling point range. Suitable first and second feed will typically have at least one different physicochemical parameter (e.g., molecular composition, boiling point range, etc.). The design rates of the sum of the first feedstock to that of the second plus third (plus, fourth, fifth, etc) will typically be such that the sum of the feeds to the first reactor is greater than the sum of feeds the second reactor. The sum of the feeds rates to the second reactor may typically be in a range of between about 25 liquid vol % (or less) when measured at standard conditions to about 90 liquid vol % (or more) of the sum of the feed rates to the first reactor. In the most preferred design the sum of the rates to the second reactor will be between about 40 liquid vol % to about 80 liquid vol %.

Suitable interbed separators particularly include hot separators, wherein such hot separators are further configured to receive at least part of the second feed and possibly a vapor feed, typically hydrogen containing, which may or may not be optional. In a particularly preferred alternative aspect of the inventive subject matter, it is contemplated that the concentration of the hydrogen in the hydrogen-containing feed may vary substantially, and while the hydrogen concentration in some configurations may be between about 50 vol % and 95 vol % (and even more), the concentration of hydrogen may also be lower (e.g., between 1 vol % and 50 vol %), or even be substantially zero. In such cases, where the hydrogen containing feed is substantially free from hydrogen (i.e., less than 1 vol %), it is preferred that the stream may predominantly comprise light-end-materials (i e., materials that will leave the separator as a gaseous component). It is also recognized that the vapor feed may be fed from its source without additional preheat. Typically the vapor source will be from a make-up gas compressor, or from a recycle gas compressor. As such the temperature of the vapor to the interbed separator can be from 80° F. to 350° F., more typically be in the range of 125° F. to 300° F., and most typically in the range from 150° F. to 275° F. Addition vapor preheat is possible and advantageous only to the extent that it may improve the plant thermal efficiency, but may also add additional capital cost.

It should be especially recognized that suitable interbed separators are preferably operated at a pressure that is at or close to the pressure in the first hydrotreating reactor and at a pressure that is at or above the pressure of the second hydrotreating reactor. Consequently, suitable interbed separators will typically be operated at between about 500-2400 psi. However, where suitable it should be appreciated that the pressure may also be less than 700 psi and especially contemplated lower pressures are generally between 700 to 400 psi, and even less. Similarly, where hydrotreating conditions allow, interbed separators may also be operated at a pressure above 2400 psi, and suitable higher pressures include pressures between 2400 to 4000 psi, and even higher. Due to the relatively high partial pressure of hydrogen in the separator (the hydrogen may be hydrogen that is recycled within the plant), it is contemplated that the effective hydrocarbon vapor partial pressure is less than 200 psi, and more typically within a range of between about 80 psi to 180 psi, and most typically within a range of between about 30 psi to 150 psi.

In a particularly contemplated aspect of the inventive subject matter, it is contemplated that the interbed separator is operated such that the temperature of the hydrogenated product from the first hydrotreating reactor will evaporate at least part of the second feed. Thus, in especially preferred configurations, the at least part of the hydrogenated product will be in a gaseous, or vapor phase, and at least part of the second feed (e.g., at least 50%, more typically at least 75%, even more typically at least 85%, and most typically at least 80% or 100%) will be vaporized by the heat of the first feed. Consequently, it should be appreciated that the energy required to operate the second hydrotreating reactor will predominantly be provided by the heat and pressure of the first hydrotreating reactor.

With respect to particular temperatures, it is contemplated that the first reactor will preferably operate at about 650° F., the interbed separator will preferably operate at a temperature of between about 650° F. and about 600° F., and the second reactor will preferably operate at a temperature of about 600° F. However, it should be recognized that depending on the particular feed of the first and second reactors, the pressures and temperatures may vary accordingly. With respect to the temperature regulation in the second hydrotreater, it should be recognized that the temperature in the second hydrotreating reactor may be regulated by feeding at least a portion of the second feed, or an additional feed to the second reactor.

Additionally, it should be appreciated that the products from the first reactor (i.e., the first feed) preheat and vaporize at least part of the second feed. Consequently, it is contemplated that the so produced vapor will comprise a portion of one or both feeds (typically in the same boiling range), and that the so produced vapor is fed in contemplated configurations to the second reactor (which may contain one or more catalyst beds). It is also contemplated that the liquid remnants from the interbed separator first feed, somewhat cooled from vaporizing the second feed, can be fed directly to the first feed product stripper without additional stripper preheat. It is also contemplated that an intermediate pressure (a pressure set between the operating pressure of the interbed separator, and the pressure of the stripper) flash drum in the feed stream to the stripper may be included to provide a means for safely letting down the pressure and to recover dissolved hydrogen from the stripper feed. It is also contemplated that the liquid remnants from the interbed separator first feed stock may pass through equipment other than an intermediate pressure flash drum (e.g., heat exchangers, pumps, etc.), en route to the first feed product stripper.

By integration of two hydrotreating reactors into contemplated configurations, costs for construction and operation of contemplated plants will be significantly reduced. For example, it is contemplated that the cost for a hydrogen recycle compressor in contemplated configuration will be substantially lower than the cost for two independent recycle compressors. Additionally, it is contemplated that a common set of fractionation columns (herein referred to as a gas plant) designed to separate light hydrocarbon fractions can be used downstream of the product stripper columns can be installed for substantially less cost than for two independent gas plants. In yet another aspect of the inventive subject matter, it should be appreciated that the energy required to operate the second hydrotreating reactor will predominantly be provided by the heat and pressure of the first hydrotreating reactor. Consequently, it is contemplated that a second heater for the second reactor may be omitted.

Furthermore, it should be recognized that the product of the second hydrotreating reactor (here: being lower boiling point material) is well suited to sponge (i.e., at least partially remove) light hydrocarbon components that are not condensable at typical hydrotreating operating conditions (temperatures and pressures). Removing these non-hydrogen components from the recycle gas purifies the hydrogen rich recycle gas to the first reactor section. Compounds that will be removed (sponged by the products from the second reactor) from the recycle gas include methane, ethane, propane, and butanes. Purification of the hydrogen rich recycle gas will advantageously remove essentially inert, light end components and increase the hydrogen partial pressure thereby reducing the size of the equipment(e.g., reactors), and the amount of hydrotreating catalyst required.

In a still further aspect, it should be recognized that by fluidly coupling the first reactor to the second reactor, the second reactor is operating at a significantly higher pressure than a typical standalone design designed only to treat the lighter second feed, thereby significantly reducing the amount of required catalyst for the second reactor. This reduction in catalyst amount in the second reactor greatly offsets the additional costs associated for designing the second reactor at the higher pressure.

Dimensions and capacities of contemplated hydrotreating reactors will typically depend at least in part on the particular feedstock, and the overall throughput capacity of the hydrogenation plant. Thus, it is contemplated that all known hydrotreating reactors are suitable for use herein. Consequently, the nature of the catalyst may vary considerably. However, preferred hydrotreating catalysts may include those comprising cobalt, molybdenum and/or nickel distributed on a carrier (e.g., alumina extrudate).

It should also be appreciated that suitable configurations may include additional hydrotreating reactors (i.e., a third reactor, a fourth reactor, etc.) and separators, wherein each of the additional reactors are fluidly coupled to an existing or preceding reactor via a separator that receives the product of the existing or preceding reactor, and that removes at least one component of an additional feedstock for the additional reactor. With respect to the components (e.g., piping, hydrotreating reactor, compressor, heat exchanger, etc.) in contemplated configurations, it is contemplated that all known and commercially available components may be employed. Furthermore, contemplated configurations may be realized in a new plant, however, it is especially preferred that a separator and a second hydrotreating reactor are integrated as an upgrade into an existing hydrotreating plant.

Consequently, a method of operating a plant may comprise a step in which a first hydrotreating reactor, a second hydrotreating reactor, and an interbed separator that receives a first feed and a second feed are provided. In a further step, the interbed separator is fluidly coupled to the first and second hydrotreating reactors. In a still further step, the first hydrotreated feed is used to preheat and vaporize at least part of the second feed, thereby producing a preheated and at least partially vaporized second feed, and in yet another step, at least a portion of the preheated and at least partially vaporized second feed is mixed with the remaining second feed and is fed into the second hydrotreating reactor. With respect to the first and second hydrotreating reactors, the interbed separator, the feeds and feedstocks, the hydrotreated product, and the hydrotreated product, the same considerations as described above apply.

Thus, specific configurations and methods of improved hydrotreating have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, to terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A system for integrated hydrotreating of a first and a second feedstock with different boiling point ranges, comprising:

an interbed separator that is configured to produce a separator liquid and to receive a first hydrocarbonaceous feed and a second hydrocarbonaceous feed, wherein the first feed has a temperature that is effective to preheat and vaporize at least part of the second feed, thereby producing a preheated and at least partially vaporized second feed;

wherein the first hydrocarbonaceous feed has a higher boiling point range than the second hydrocarbonaceous feed;

a first hydrotreating reactor configured to provide the portion of the first feed, and a second hydrotreating reactor configured to receive at least a portion of the preheated and at least partially vaporized second feed and to produce a liquid product; and wherein the plant is further configured such that the liquid product and the separator liquid are separately withdrawn from the system.

2. The system of claim 1 wherein the interbed separator comprises at least a partial vapor liquid equilibrium stage.

3. The system of claim 1 wherein the interbed separator comprises at least two vapor liquid equilibrium stages.

4. The system of claim 1 wherein the interbed separator is a trayed column or a packed column.

5. The system of claim 1 wherein the first feed comprises hydrotreated gas oil or cycle oil from a fluid catalytic cracking reactor.

6. The system of claim 1 wherein the second feed comprises diesel oil or cycle oil from a fluid catalytic cracking reactor.

7. The system of claim 1 wherein the interbed separator further receives a hydrogen containing stream.

8. The system of claim 7 wherein the hydrogen containing stream is recycled in the plant.

9. The system of claim 7 wherein at least a portion of the hydrogen containing stream is a make-up hydrogen stream.

10. The system of claim 1 wherein the interbed separator is operated at a pressure of between about 500 psi to about 2400 psi.

11. The system of claim 10 wherein the second hydrotreating reactor is operated at a pressure of between about 700 psi and about 2000 psi.

12. The system of claim 1 wherein at least a portion of the second feed is fed into the second hydrotreating reactor.

13. The system of claim 1 wherein a third feed is fed to the second hydrotreating reactor.

14. The system of claim 12 wherein the portion of the second feed has a temperature effective to regulate a temperature in the second hydrotreating reactor.

15. The system of claim 12 wherein the portion of the second feed controls recovery of a lighter boiling range material from the hydrotreated first feed in the interbed separator.

16. The system of claim 1 wherein the interbed separator and the second reactor are integrated as an upgrade into an existing hydroprocessing plant.

17. The system of claim 1 wherein the first hydrotreater receives a first total feed and the second hydrotreating reactor receives a second total feed, and wherein the second total feed is between 25 vol % to 90 vol % of the first total feed.

18. The system of claim 1 wherein the first hydrotreater receives a first total feed and the second hydrotreating reactor receives a second total feed, and wherein the second total feed is between 40 vol % to 80 vol % of the first total feed.

19. A method of hydrotreating at least two distinct hydrocarbonaceous feeds to form at least two distinct hydrotreated products, comprising:

providing a first hydrotreating reactor, a second hydrotreating reactor, and an interbed separator that receives a first hydrocarbonaceous feed and a second hydrocarbonaceous feed, wherein the first hydrocarbonaceous feed has a higher boiling point range than the second hydrocarbonaceous feed;

fluidly coupling the interbed separator to the first and second hydrotreating reactors;

using the first feed to preheat and vaporize at least part of the second feed, thereby producing a preheated and at least partially vaporized second feed;

and feeding at least a portion of the preheated and at least partially vaporized second feed into the second hydrotreating reactor; and separately withdrawing a hydrotreated first hydrocarbonaceous fluid from the interbed separator and a hydrotreated second hydrocarbonaceous fluid from the second hydrotreating reactor.

20. The method of claim 19 wherein the first feed comprises a gas oil boiling range material and wherein the second feed comprises a material with a lower boiling range than gas oil.

21. The method of claim 19 wherein the interbed separator is operated at a pressure of between about 500 psi and about 2400 psi, and wherein the second hydrotreating reactor is operated at a pressure of between about 700 psi and about 2000 psi.

22. The method of claim 19 wherein the second hydrotreating reactor produces a product that sponges components from a recycle gas that is created at least in part in the first hydrotreating reactor.

23. A system for integrated hydrotreating of a first and a second feedstock with different boiling point ranges, comprising:

an interbed separator that receives a first hydrocarbonaceous feed and a second hydrocarbonaceous feed, and that forms a first hydrotreated liquid, wherein the first feed preheats and vaporizes at least part of the second feed, thereby producing a preheated and at least partially vaporized second feed;

wherein the at least a portion of the first feed is provided by a first hydroprocessing reactor, and wherein at least a portion of the preheated and at least partially vaporized second feed is fed into a second hydroprocessing reactor that produces a hydrotreated product;

wherein the first hydrocarbonaceous feed has a higher boiling point range than the second hydrocarbonaceous feed;

wherein at least a portion of the second feed is fed into the second hydroprocessing reactor; and wherein the system is further configured to allow separate withdrawal of the first hydrotreated liquid and the hydrotreated product.

24. A system for integrated hydrotreating of a first and a second feedstock with different boiling point ranges comprising:

an interbed separator that receives a first hydrocarbonaceous feed and a second hydrocarbonaceous feed, wherein the first feed preheats and vaporizes at least part of the second feed, thereby producing a preheated and at least partially vaporized second feed;

wherein at least a portion of the first feed is provided by a first hydroprocessing reactor, and wherein at least a portion of the preheated and at least partially vaporized second feed is fed into a second hydroprocessing reactor that produces a product;

wherein the first hydrocarbonaceous feed has a higher boiling point range than the second hydrocarbonaceous feed; and wherein a third feed is fed into the second hydroprocessing reactor.

* * * * *